US005611726A

United States Patent [19]

Friel et al.

[11] Patent Number: 5,611,726

[45] Date of Patent: Mar. 18, 1997

[54] HIGH SPEED PRECISION SHARPENING APPARATUS

[75] Inventors: Daniel D. Friel, Greenville; Robert P. Bigliano, Wilmington, both of Del.

[73] Assignee: Edgecraft Corporation, Avondale, Pa.

[21] Appl. No.: 431,497

[22] Filed: Apr. 28, 1995

[51] Int. Cl.[6] ..... B24B 9/00

[52] U.S. Cl. ..... 451/177; 451/259; 451/267; 451/282; 451/293

[58] Field of Search ..... 451/177, 178, 451/185, 192, 193, 259, 262, 263, 267, 282, 293, 548, 65

[56] References Cited

U.S. PATENT DOCUMENTS

| | | | |
|---|---|---|---|
| 1,172,860 | 2/1916 | Aschburner | 451/549 |
| 2,841,926 | 7/1958 | Lebus | 451/451 |
| 3,332,173 | 7/1967 | McMaster et al. | 451/282 |
| 4,128,972 | 12/1978 | Charvat . | |
| 4,504,283 | 3/1985 | Charvat | 451/526 |
| 4,716,689 | 1/1988 | Friel | 451/282 |
| 4,807,399 | 2/1989 | Friel | 451/282 |
| 4,915,709 | 4/1990 | Andrew et al. | 451/259 |
| 5,018,310 | 5/1991 | Fierus et al. | 451/192 |
| 5,245,791 | 9/1993 | Bigliano et al. | 451/282 |

*Primary Examiner*—Bruce M. Kisliuk
*Assistant Examiner*—Thomas W. Lynch
*Attorney, Agent, or Firm*—Connolly & Hutz

[57] ABSTRACT

A high speed knife sharpening apparatus where the surface of a first rotating abrasive element is that of a truncated cone and forms a first facet with microgrooves and a microburr. A second stage is a novel composite cone shaped honing wheel made up of a micro abrasive imbedded in an epoxy matrix. The honing wheel refines the edge developed in the first stage, into an erect triangular shape with a radius of curvature, at the apex (edge), of typically several microns or less depending on the hardness of the knife steel. A unique blade holding system constrains the blade to a precisely defined angle relative to each of the grinding (first) and honing (second) stages. Proportionately larger grinding forces are developed for thicker knife blades, thus sharpening times are approximately the same over the common range of knives from small paring knives (6"), large chef's knives (10") up to kitchen cleavers.

46 Claims, 7 Drawing Sheets

4
2
1
8
V
33
37
9
15
15

V
4
13
11
14
15

HIGH SPEED PRECISION SHARPENING APPARATUS

BACKGROUND OF THE INVENTION

This invention relates to knife and blade sharpeners of the type that use disk type sharpening members.

Household and commercial knife sharpeners incorporate high-speed cylindrical stones rotating at surface velocities of 2,000 feet per minute (U.S. Pat. No. 2,775,075.) These sharpeners generally leave a large burr (i.e. a curled-over edge of metal on the last unsharpened facet of the blade edge) and tend to overheat the edge. The presence of a sizeable burr is undesirable since it is ragged, non-uniform and creates a weak edge.

U.S. Pat. No. 4,627,194 describes sharpeners that overcame the problem of a large burr in a particular way by adding additional facets (typically 3) where each succeeding facet has a slightly larger included angle. Furthermore, each succeeding facet is formed with a finer grit until a very fine grit is used on the last (third) facet. Thus burrs never become large or excessive. This action, while producing a well formed strong edge takes more time than is desirable in commercial environments.

Prior art sharpeners that create large burrs require post treatment as with a steel rod or a cloth buffing wheel to align the burr. Sharpening steels and cloth wheels are time consuming and generally leave a weak edge that will need frequent resharpening.

Many of the prior art sharpeners of the household type provide poor control of the blade position and angle of the knife edge facet relative to the sharpening disk. U.S. Pat. No. 4,627,194 describes a magnetic hold down mechanism, but it is possible for the user to forcibly override the magnetic field. Other prior art sharpeners, used commercially, provide complex and unreliable clamping mechanisms to insure proper knife position and angle of the cutlery edge facet. Users find these cumbersome and difficult to use.

Another disadvantage of many prior art sharpeners is that they provide no control of the force of the grinding surface on the knife facet. Thus the speed of sharpening will vary depending on blade thickness. Furthermore, this lack of control can result in the user applying too much force, thus overheating the knife edge locally, degrading the edge temper or creating a nonuniform cutting edge.

SUMMARY OF INVENTION

This invention provides a unique sharpener that can rapidly create edges better than razor sharp on a wide range of conventional blades. This is accomplished by a unique combination of one or more sharpening stages followed by a novel honing stage. Rigid cone shaped abrasive coated disks are used to create a first edge that has a geometry and a burr that can be suitably modified by the subsequent flexible cone shaped abrasive-loaded honing stage to create an ultra sharp and durable edge. It can be used on a variety of blades and is especially suited for knife blades.

Many disadvantages of prior art knife sharpeners are significantly reduced by the sharpening methods and apparatus of this invention.

DETAILED DESCRIPTION

Figure 2:
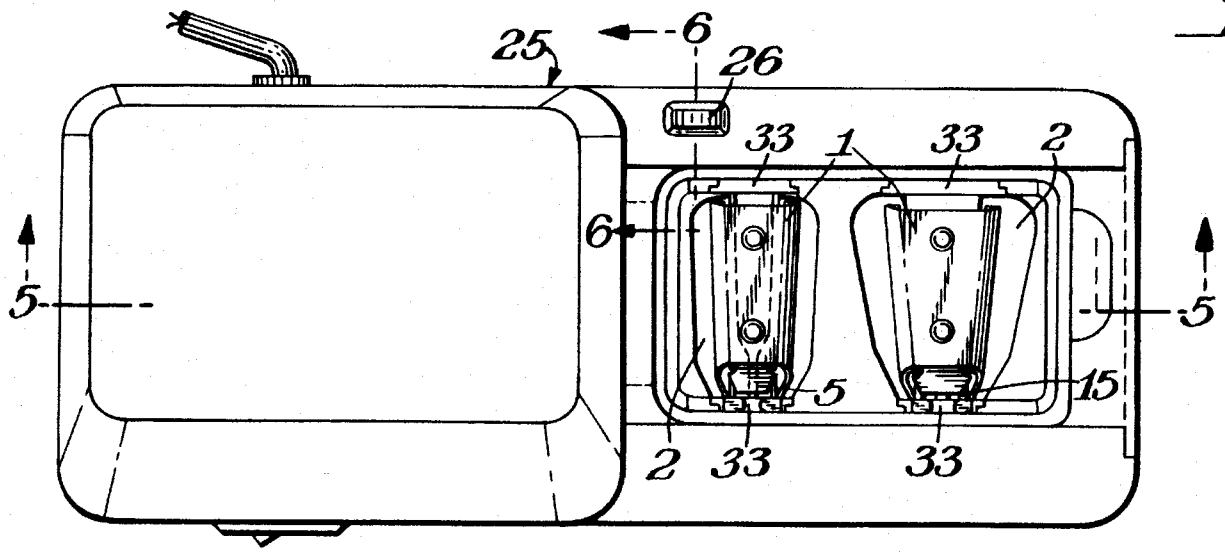
FIG. 2 is a top plan view of the sharpening apparatus of FIG. 1.
Figure 1:
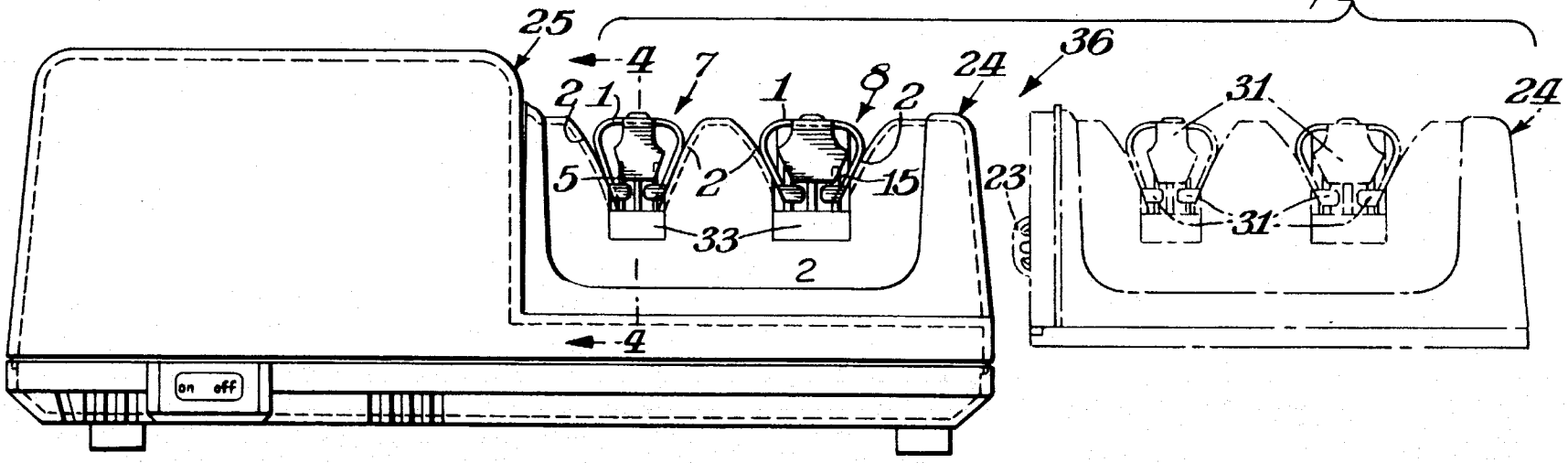
FIG. 1 is a side elevational view of a sharpening apparatus in accordance with this invention also showing the sharpening and honing blade sections both in place and removed.

The sharpener (36) of this invention is shown in FIG. 1 and includes a first sharpening section or stage (7) and a honing stage (8). In the sharpening stage there are two abrasive coated truncated cone shaped disks (5,5) and in the honing stage there are two abrasive loaded truncated cone shaped disks (15,15). In both stages the disks are mounted on slotted hubs (35) of FIG. 8 which are mounted on and rotated by a drive shaft (9). Pins (386) through the shaft (9) engage the slotted hubs which can slide on the shaft. Between each pair of disks is a spring (6) that provides a restraining force against the disks as they are displaced along its shaft during sharpening of the knife edge facets. The pins (9) serve to precisely locate the disk when at rest and to drive the hub mounted disks. In both the sharpening and honing stages the knife blade (4) is positioned against and along a knife guide surface to establish the sharpening angle and the knife edge is stabilized and guided by a small groove (37) cut in a tough, lubricous, and non abrasive edge guide (33), so as to establish a fixed and constant angle between the knife facet and the sharpening surface. In FIG. 1, the unique plastic hold down spring (1) generates a force to hold the knife against the blade guide surface (2). As the knife is drawn through the sharpener the knife edge cuts into and is stabilized, by the edge guide (33). Thus the knife is completely constrained in the plane of the knife guide surface as it is drawn through the sharpening stage against a rotating abrasive disk (5) of FIG. 8. The creation of a groove (37) in the edge guide (33) adds additional stability to the sharpening process but it is not essential to the operation of this invention. The blade (4) is held with adequate stability using the plastic spring (1) alone. In use to sharpen a conventional knife, the knife is pulled alternately and repeatedly through the left and right slots first in the sharpening stage and then in the honing stage until an exceptionally sharp edge is created.

The superior cutting edge formed by this invention depends upon the formation of a particular edge geometry in the sharpening stage or stages followed by a special honing action by an appropriately flexible abrasive-loaded honing disk. Both the sharpening and honing stages use cone shaped disks driven at appropriate speeds to accomplish their special functions and to create quickly an ultrasharp edge. Novel means is used in both sharpening and honing stages to stabilize the blade and control the sharpening angle. The sharpening disks (5,5) are commonly formed from metal about 1/16 inch thick in the shape of a truncated cone with its surface sloped at several degrees to the normal to the cone axis. The conical surface is coated with a layer of abrasives—preferably diamonds—that cut cleanly and with little heating.

The abrasive speed against the knife edge is controlled to eliminate blade detempering due to over-heating. The sharpening disk (5) and honing disk (15) rotate in a speed range of 1300 to 1600 rpm while the knife edge contacts the disks at a radius in the range of 0.5 to 0.9 inches, preferably about 0.75 inches. Thus, the linear sharpening speed is approximately between 750 and 400 feet per minute, well below the range of approximately 1000 feet per minute at which speed overheating could occur on the diamond coated sharpening disk (5).

Figure 8:
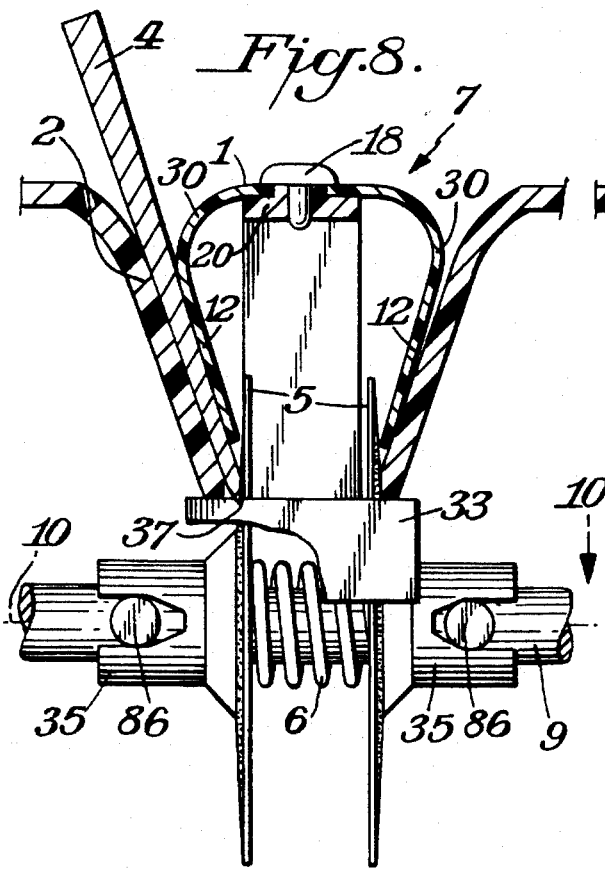
FIG. 8 is a side elevational view showing a large knife being sharpened in the sharpening section of the apparatus of FIGS. 1–6.

FIG. 8 is an expanded view of the sharpening section showing the knife blade (4) in place between the plastic hold down spring (1) and the blade guide surface (2). The force of the plastic spring is sufficient to completely hold the knife against the knife guide surface so that the user need only pull the knife through the sharpener. As the knife is moved down toward the knife edge guide (33) it contacts the rigid rotating sharpening disk (5) and moves the sharpening disk along its axis (10) against a spring (6) toward the center of the sharpening stage until the knife edge facet physically contacts the knife edge guide (33). The edge of the knife forms a small groove (37) in the knife edge guide and becomes firmly fixed relative to the blade guide surface (2). The correct angle, defined by the angle of the blade guide surface (2) is established and maintained ±0.5° throughout the entire length of the knife blade (4) as it is drawn through the knife sharpener (36).

The point of contact and the location of the subsequent groove (37) formed by the knife edge against the knife edge guide (33) will vary depending on the thickness of the knife (4) at its edge. Once a groove (37) is formed it will secure further the edge from lateral movement. Alternatively, the groove (37) can be preformed. Importantly, the material used to construct the knife edge guide (33) is selected to be non abrasive and to have high lubricity and high toughness. Surprisingly, high molecular weight polypropylene and ultra high molecular weight polyethylene which have the necessary lubricating and toughness proved not to damage the ultrafine edges created by the honing methods described herein. These materials were shown surprisingly to improve slightly the edge quality. The guides are designed so that they can be readily inverted to expose fresh areas and to be readily replaced when excessively worn. The discovery that these edge guides (33) can be used to act as a stop and a rest for the blade (4) without damaging the edges is important in that it allows the abrasives on the sharpening disk to move away from the edge (not into the edge). Any force or thrust that the moving abrasive imparts to the blade will tend to press the blade edge against this guide (33). Without these edge guides the knife would jam between the disk and the guide structure, unless the direction of disk rotation were reversed. The reverse rotation direction will create a very poor rolled edge in the sharpening section and cause the knife to cut into and destroy the honing disk.

Figure 7:
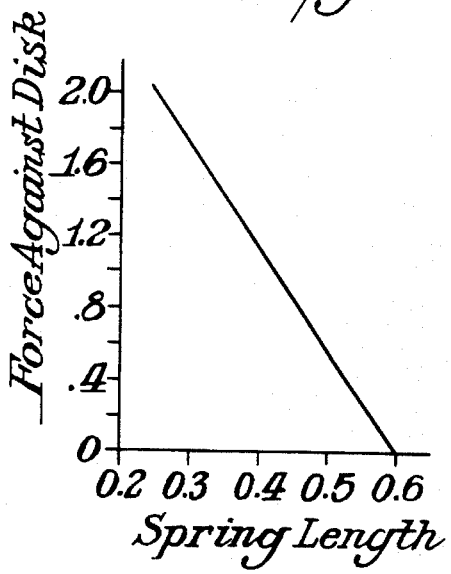
FIG. 7 is a graph showing the relationship between the spring length and the force against the disk.

The sharpening force is established by the displacement of spring (6) in FIG. 8 and is a function of the thickness of the blade (4) at the point of contact with the sharpening disk (5). FIG. 8 shows that a thick blade displaces the sharpening disk (5) more than a thin blade as in FIG. 9. FIG. 7 shows a typical relationship between displacement of the spring and force against the disk. The spring is designed to have an appropriate finite force at zero displacement of the disk. The preferred force range is approximately 0.6 to 1.4 pounds for both the sharpening and honing disks during the displacement of the disk of about 0.1 to 0.15 inches along the shaft.

Hold Down Spring

Figure 9:
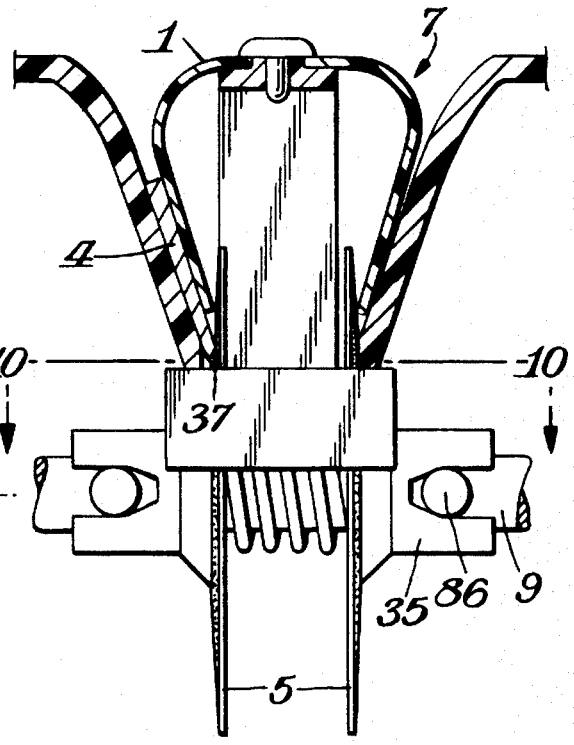
FIG. 9 is a view similar to FIG. 8 showing the sharpening of a small knife.
Figure 11:
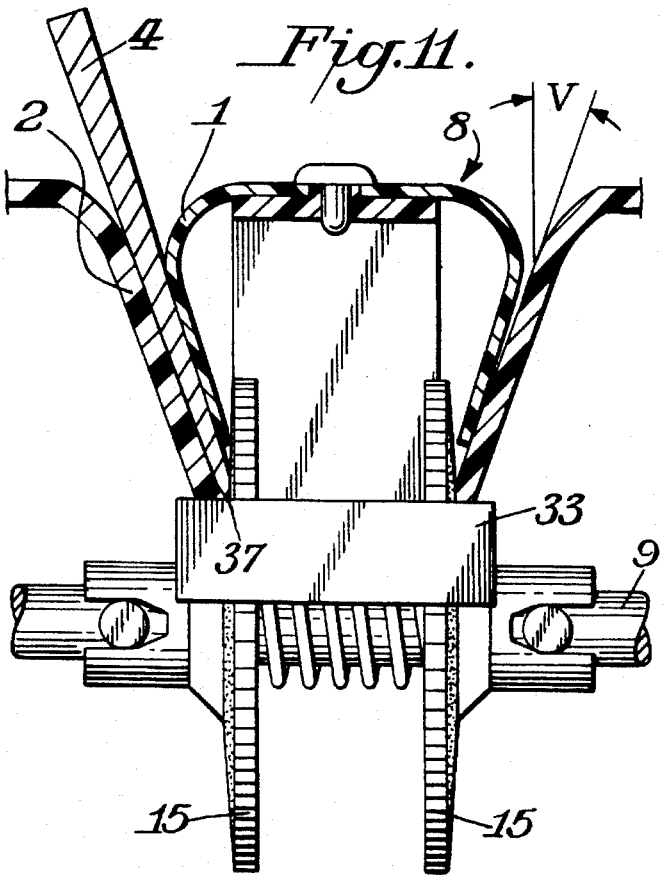
FIG. 11 is a cross-sectional view similar to FIG. 8 showing a large knife in the honing section of the apparatus of this invention.

The hold down spring (1) of FIGS. 8 and 9 is an elongated inverted U shaped structure made of plastic such as polymerized methyl methacrylate (Lucite or Plexiglass brands for example) or a thin metal such as stainless steel. The arms (12) of the spring which are about 30–60 mils thick if plastic, extend downward from the shoulder section (30) of the inverted U shaped structure and in the absence of a knife in the sharpener rest against the lower portion of the knife guide plane (2) at the extremities of the arms as shown by the right arms in FIGS. 8, 9 and 11. When a knife is inserted between the knife guide surface (2) and the spring (1), the spring arm (12) will bend along its length as shown in FIGS. 8, 9 and 11 to conform at least in part to-the shape of the blade face. The thickness of the spring material is carefully selected to bend adequately to provide conformity along the lower part of the blade face. The spring is designed so that in its normal (no knife inserted) position the end of the spring presses against the knife guide surfaces (2) providing an initial force. The spring is supported at its upper midpoint by the boss (20) of the structural support and held in position by a pin (18). More than one boss can be used along the length of the spring. The clearance between the hole in the spring (1) and the supporting boss (20) can be varied to allow the spring to tilt slightly about its horizontal axis or to move laterally in order to accommodate a greater variety of knives of different thickness and to modify the spring action and consequent forces and conformity by the spring against the knife face. Preferably the spring is designed of a length to extend along most of the length of the knife guide plane from the front to the rear of the sharpening stages. A special configuration of this spring incorporates guard sections (31), shown in phantom in FIG. 1, that to a great extent cover the front and/or rear sections of the spring opening in order to limit accidental access of human fingers into the area of the sharpening and honing disks where injury could occur. The spring (1) can be molded either to an initial shape that closely conforms as molded to the knife guide surfaces or to an initial shape that requires that the arms be sprung toward each other significantly in order to fit against the knife guide surfaces. The latter has the advantage that it gives the spring a greater holding force against the blade face when it is inserted between the spring and knife guide surface. The latter proved to be a preferred geometry for molding as the added force gave greater stability to the blade.

The plastic hold down spring (1) is distorted more by a thicker blade than a thinner blade providing greater holding force of the blade against the knife guide surface (2). The hold down spring (1) shown in FIGS. 8, 9 and 11 is held in place at the top of the spring (1) with a snug fitting pin (18) in hole (19) through a support member (20), such as a boss. For thick knives, the flexible spring will change its shape significantly as shown in FIGS. 8, 9 and 11 to accommodate the knife. With a thick blade (4) the spring (1) will conform to the face of the blade along most of the arm length and with the thickest blades the shoulder section (30) of the spring (1) will contact the blade (4) providing a portion of the hold down force. With thicker blades the spring (1) will tilt slightly or move laterally until the opening in its midpoint is pushed tightly against support boss (20). More of the spring length is involved in the process, hence increasing the hold down force.

Creating the Knife Edge:

The method used in this invention to create the knife edge establishes a durable cutting edge with sharpness better than a conventional razor in less than 45 seconds for a knife not previously sharpened by the device of this invention and in less than 20 seconds when resharpening a knife previously sharpened by the device of this invention. This is extremely fast to achieve an edge of this ultra sharpness. Typically, a knife previously sharpened by this invention can be resharpened simply by passing it through the "honing" stage (8) of FIG. 1, to recreate the original sharpness. This resharpening can be repeated up to 5 times before the user will find it necessary to "resharpen" the knife in the sharpening stage, (7) of FIG. 1.

Sharpening Stage

Figure 4:
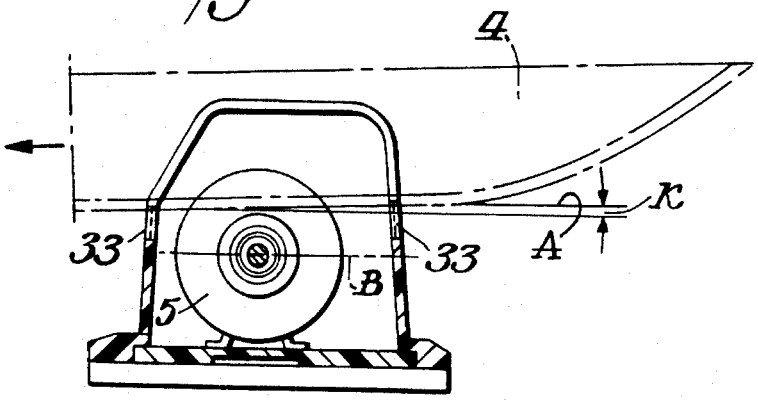
FIG. 4 is a cross-sectional view taken through FIG. 1 along the line 4—4.
Figure 20:
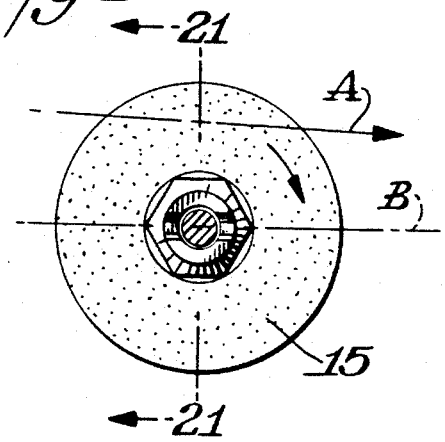
FIG. 20 is a left end elevational view of the honing disk used in the apparatus of this invention and also showing the path of movement of the knife.
Figure 21:
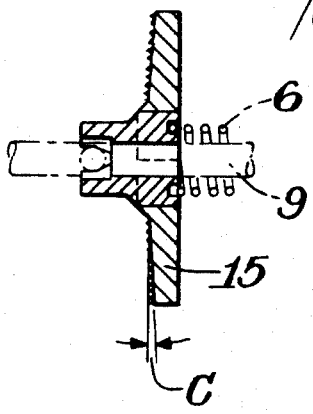
FIG. 21 is a cross-sectional view taken through FIG. 20 along the line 21—21.

Preferably the knife edge facet contacts the cone shaped sharpening disk at a point as shown along the line (A) of FIGS. 4 and 20 which is above the center line (B) of the disk a distance approximately 45–80% of the disk radius. The position of this line is selected in any event to produce nominally unidirectional grooves in the facet preferably at an angle of 20 or more degrees to the edge. (If contact were at line (B) along the diameter line of the disk the microgrooves would be perpendicular (90°) to the edge.) The knife is guided through the sharpening stage (7) of FIGS. 1 and 8 by the knife guide surface at an angle, such that the knife edge conforms approximately to the surface of the upper forward section of the truncated sharpening disk (5) and contacts the disk in that section. In this manner the abrasive surfaced sharpening disk (5) produces essentially unidirectional microgrooves along the facet that extend to the edge and leave a microburr along the edge. The use of diamonds for the abrasive is especially desirable as it creates well defined microgrooves; other abrasives tend to smear out the grooves leaving grooves that are irregular in shape and spacing. Only the upper forward portion of the sharpening disk (FIGS. 8 and 18) contacts the knife facet. This is in contrast to teachings where the disk is flat and/or where the abrasive is moved in a direction that is into the edge.

The sharpening disk is made preferably by electroplating diamonds onto a thin metal truncated cone structure where the metal is about 0.030 inches thick. It can of course be thicker. Importantly diamonds are used as abrasives since they are extremely hard and durable and wear so little that they will maintain the shape of the conical disk on which they are plated for an extremely long time. This is in sharp contrast to abrasive stone, bonded alumina or bonded carborundum wheels that loose their shape and angular surface contour very rapidly at the point of contact with a blade in use. Such alternates will not work in a precise sharpener as described here where the angular relationships of the sharpening angle is highly critical for optimal performance and creation of the ultrasharp edge sought with this sharpener. Such solid abrasive wheels would be totally impractical for other reasons: they would heat the edge excessively, detempering the blade and create less well defined grooves across the facet. The use of diamond abrasives on a rigid substructure is essential to the optimal performance of this sharpener. The spring tension that presses the diamonds against the knife facet must be carefully chosen as described herein to optimize the sharpening rate and the groove formation.

The number of microgrooves formed in the sharpening stage along the first facets depends upon the rotational speed of the abrasive coated truncated cone disks, the abrasive grit size, the point of contact with disk, and the speed at which the user moves the knife across the sharpening disks. With the wheel speeds at 1300 to 1600 revolutions per minute and grit size of 140/170 and the point at which the knife contacts the disks, the spacing of grooves along the edge are on the order of 0.0005 to 0.005 inches apart, commonly about 0.001" apart. The burr size varies along the edge but is generally has a length less than 0.002", commonly its length is in the range of 0.0004 to 0.001 inch.

Figure 10:
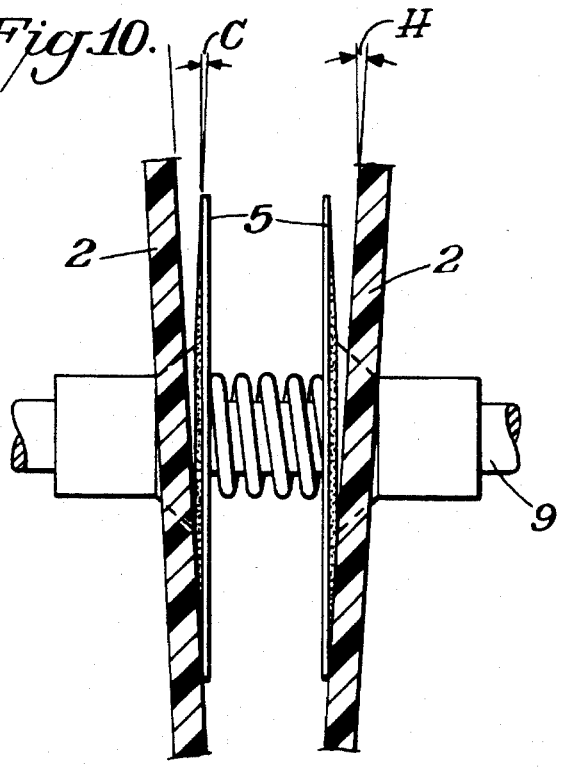
FIG. 10 is a cross-sectional view taken through FIG. 9 along the line 10—10.
Figure 18:
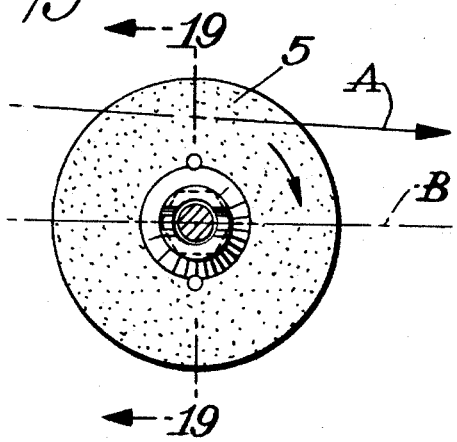
FIG. 18 is a left end elevational view of the sharpening disk used in the apparatus of this invention.
Figure 19:
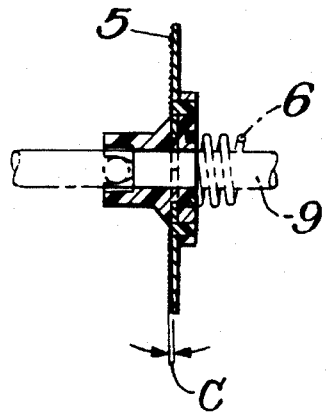
FIG. 19 is a cross-sectional view taken through FIG. 18 along the line 19—19.

The projected path (A) of the knife edge across the disk surface (5), in FIGS. 4 and 18 is along a chord of the truncated cone, hence the path laid out on the surface of the cone is actually curved more or less parabolic in shape. The nominal knife path as shown in FIG. 10 is angled (H) at typically 2°–10° to the normal to the axis of rotation for the sharpening disk. An advantage of this design is that the knife contacts the abrasive cone surface more or less at a point or along a small line (approaching a point) which provides for more uniformly formed and angled microgrooves, than if the entire line of abrasives contacted the blade.

Throughout this disclosure the shape of the surface of the disk is referred to as that of a truncated cone. This is an optimal shape because it gives a surface of low curvature at the point where the knife edge contacts the abrasive. The low curvature that can be built into a low angle cone tends to extend the contact into a short line. The greater the curvature the smaller the contact line until it becomes close to a true point contact. Other curved surfaces such as large radius spheres, parabolic, elliptical surfaces, or special contours could be used. The cone shape tends to align well with the knife guide structures and allows the knife edge to contact the abrading surface near the front of the sharpener, allowing sharpening and honing closer to the handle of blades. Hence other shapes can be used in either the sharpening or honing stages although the cone is a near optimal shape.

Figure 13:
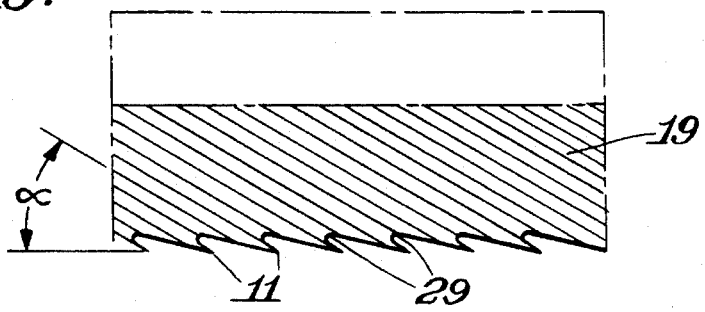
FIG. 13 is an enlarged side elevational view showing a blade facet resulting from use of the sharpening section of the apparatus of this invention.
Figure 14:
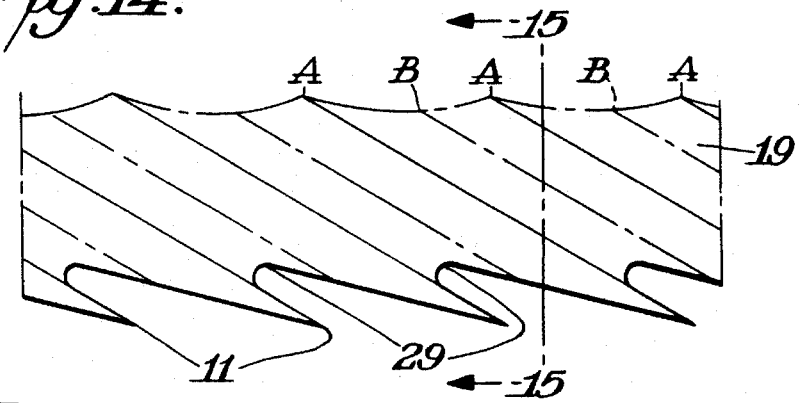
FIG. 14 is an end elevation view of the blade of FIG. 13.
Figure 15:
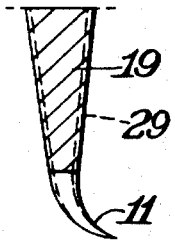
FIG. 15 is a cross-sectional view taken along the line 15—15 of FIG. 14.

In the sharpening stage or stages it is desirable to create a series of microgrooves (29) across the facets that extend to the cutting edge for example as shown in FIGS. 13 and 14. These grooves (29) are modified and sharpened further in the subsequent honing stage to create an ultra sharp edge modified to retain some of the microgrooved structure but leave an edge as in FIG. 17 that has what chefs call "bite"—that is an edge that will easily start a cut on food or other material. The character or "feel" of the knife edge can be adjusted by controlling the depth and number of grooves per inch and by the extent of subsequent honing. Depending on the selected diamond grit sizes from 100 grit to 600 grit one can create edges that "feel" substantially different under a variety of cutting applications. A grit size of 140/170 gives an edge that is preferred by many of the professional chefs. The sharpening stage is designed to form an edge with microgrooves (29) running down the facet (19) in FIGS. 13–14 to the edge, and simultaneously the burr (11) of FIGS. 14 and 15 is also formed along the edge. The word burr is used to describe an extension at the edge often inconsistent in shape that deviates from the geometric extension of a cross section of the last facet bevel angle adjacent to the edge. The burr (11) generated by the sharpening station is shown in magnified cross section in FIG. 15 and is a distorted geometric extension of the facet (19) last exposed to the grinding surface. After the burr is formed in the sharpening station (7) of FIG. 1, the knife is placed in the honing station (8) of FIG. 1, where the burr (11) comes in contact with the unique honing disk (15) of FIG. 11. The knife guide surface in the honing stage is set at a slightly larger angle to the vertical (several degrees larger) than that of the previous sharpening stage. In the sharpening stage each of the two knife guide surfaces are tilted back from the vertical about 15 to 25 degrees, the specific angle V of FIG. 11 being selected with reference to subsequent sharpening in the honing stage. Commonly the-guide surfaces are inclined 20° to the vertical, making it possible to place a facet on each side of the edge thus creating two facets that meet at approximately 40° apart at the edge. In the sharpening stage the surface of each abrasive coated truncated cone is inclined to the normal to the cone drive axis by approximately 2–10 degrees. Commonly these are inclined 2 degrees. See angle C, FIG. 10.

It is common to incline the knife edge about 3° to the horizontal, shown as angle K, in FIG. 4 down in the front of the sharpening stage and above the horizontal in the rear to make it more comfortable to the user and to induce the user to comfortably rest the edge on the edge guide in the front of that stage. There is also an edge guide at the rear of each knife guide surface that can be used to rest and assist in guiding the blade. Further the horizontal axis of each of the knife guide surfaces (horizontal axis as used here is defined as a horizontal line lying on the face of these guide surfaces) in the sharpening stage is also tilted relative to the normal to the drive shaft axis of the truncated cone disks by an angular amount angle H, in FIG. 10 approximately equal to the angular tilt angle C, in FIG. 10 of the surface on the truncated cone (5) relative to the normal to its drive shaft axis. These angular relationships allow the edge of the blade (4) as it is guided by the knife guide surface to pass over the upper front quadrant of the truncated cone shaped disk (5) along a line that is above the center of the disk and that crosses the disk more or less parallel to a line drawn on the surface of the conical disk tilted like the knife edge angle K, in FIG. 4 some 3° from the horizontal, as shown in FIG. 4 and FIG. 18.

These complex angular relationships insure that the knife edge in both stages will contact the conical abrading surface at a point along the prescribed line A on the upper front quadrant (upper right quadrant of FIGS. 18 and 20) of the disk. The knife edge does not contact the disk in the upper rear quadrant. Because of the ultrasharp edge created by this sharpener during honing it is critical that the knife edge be in contact with the honing wheel only at points where the surface of the honing wheel is moving away from the edge. It would be disastrous if the ultrasharp edge being formed were to contact the wheel at any point where the abrasive moved into the edge. The sharp edge would promptly shave off the surface of the honing disk and destroy both the disk and the edge being formed.

Honing Stage

Figure 12:
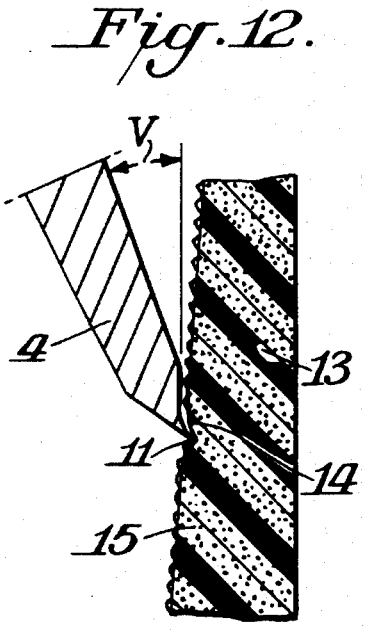
FIG. 12 is an enlarged cross-sectional view of a portion of the honing section showing the removal of a burr from the knife.
Figure 17:
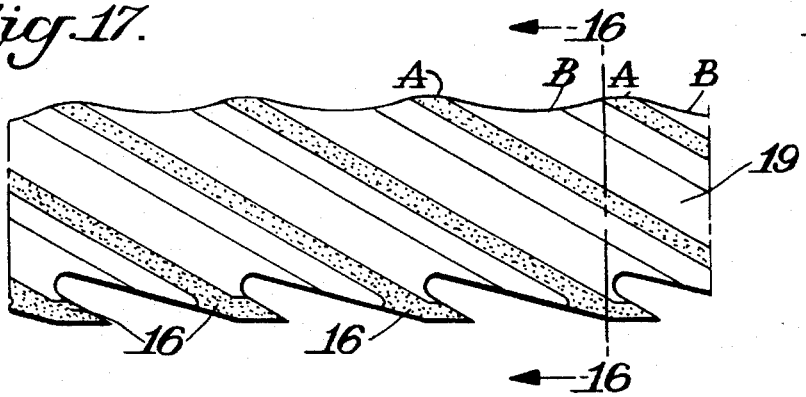
FIG. 17 is an end elevational view showing the burr removed and the edge reshaped from a knife after being honed in the honing section of the apparatus of this invention.
Figure 16:
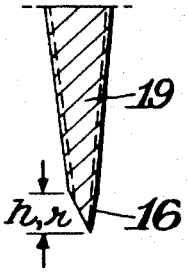
FIG. 16 is a cross-sectional view taken along the line 16—16 of FIG. 17.

The honing disk (15) is designed to flex at (14), FIG. 12, the point of contact with the burr (11). The small grain size of the abrasive particles (13), typically 5 microns, micro machine the face of the burr (11) left by the sharpening stage and with continued contact with that disk the burr will be removed leaving a small facet along the edge where the burr formerly existed. Repeated honing on both facets micro grinds the burr to create a profile (16) as for example shown in FIGS. 16 and 17. This typically leaves a new small facet whose bevel face has a height (h) typically on the order of 10 microns and a radius of curvature(r) at the edge on the order of several microns. The angle of the initial larger facets previously created by the sharpening stage is less than the angle of the secondary microfacet created by the honing disk surface. The angular relationships in the honing stage described below insure that the protruding burr will contact the honing disk first and hence be selectively removed by the localized high pressure applied by the abrasive surface. The edge shapes shown in FIGS. 13–17 are only one example of the edge serration and burr geometries that can be created depending on the abrasive size, the force of the disk restraining spring, and other variables. The groove spacing may not be as regular as shown in FIGS. 13, 14 and 17 depending on the speed and consistency with which the knife is pulled across the sharpening and on irregulation of the abrasive coating. It is not uncommon to see a longer burr on the edge after the sharpening stage that extends along the edge a distance equal to many microgrooves. With sufficient honing the burr is largely removed and an extremely sharp edge is retained with interspersed remnants of the microgrooves. A cross section elevational view, in FIG. 16 shows a burr free edge with small microfacets created by the honing disk below the main facet at the edge.

In the honing stage the knife guide surfaces are preferably tilted back angle V, in FIG. 11 from the vertical several degrees more than in the sharpening stage. For example, if the vertical tilt in the sharpening stage is 20 degrees, the tilt angle V in the honing stage commonly might be about 22½ degrees. The angular range depending on the angle selected in the sharpening stages will be in the range of 17 to 27 degrees. The surfaces of the abrasive loaded truncated cone disks of the honing stages like the sharpening stage will be angled, angle C, (FIG. 10), in the range of 2°–10°. However for example if the sharpening stage cones are angled at 2°, it is preferable that the surfaces of the honing disks be angled at a larger angle of about 7° to the normal to the drive axis of the honing disks.

As in the sharpening stage it is preferable to incline, angle K, the knife edge about 3° to the horizontal in the honing stage for the same reasons.

However, the horizontal axis of each of the knife guide surfaces in the honing stage would be tilted relative to the normal to the drive shaft axis of the truncated cone disks by an angular amount, angle H of FIG. 10, approximately equal to the angular tilt, angle C, of the surface of the truncated cone relative to its normal to its drive shaft axis. Consequently that horizontal axis of each guide surface would be tilted about 7° for this example. It would in any event be tilted with an angle H on the order of 2–10 degrees.

These angular relationships insure the knife edge will contact the conical abrading surface at a point along the upper front quadrant (upper right quadrant as shown in FIG. 20) of that disk, similar to the contact point on the sharpening disk.

The angle of the blade facets created in the sharpening stage will be slightly larger than the vertical angle, angle V, established by the knife guide surfaces. For example if the knife guides vertical angle is 20°, if the cone surface angle C is 2° and if the knife guides are tilted 2° in the horizontal, angle H, the angle formed on the blade facet will be between 20° and 22°, the exact angle depending on the particular location of the point of contact of the knife edge with the disk surface. Similarly in the honing stage with the knife guide surfaces at 22½ degrees to the vertical, the cone surface at 7° as defined above, and the knife guides set at 7° to the horizontal, the new small facet at the edge will be between 22½ and 29½°. However, because of the flexibility of the disk that allows the disk to distort and conform in part to the shape of the major facet established in the sharpening stage, the angle of the new small facet is more indefinite. It will in any case be larger than 20° for this example.

Referring to FIG. 15, the burr (11) that remains along the edge after the sharpening stage is a bent structure (as shown in FIG. 15) that is bent away from the center axis of the blade in a direction away from the last side of the blade that encountered the abrasive coated sharpening disk. In FIG. 15 the burr (11) is bent to the right indicating the last abrasive coated sharpening disk surface was abrading the left facet of the edge structure shown in FIG. 15. When that blade is placed in the honing stage and the burr on the right side encounters the abrasive loaded honing disk, that disk will begin to remove the extended burr and after several passes across that disk, it is abraded back to its root. On alternate passes through the honing slot, the other honing disk abrades the other side (left in FIG. 15) of the facet creating a micro-facet there that at first will be at a slightly larger angle to the blade axis than the original facet created in the sharpening stage as described above. Because of the absence of the burr on the left side of the blade of FIG. 15, a new micro-facet will be formed by the honing disk faster on the left side of the edge than on the right side where the burr existed and consequently more metal had to be removed. However, with repeated passes of the blade through each of the slots in the honing stage, the micro-facets will be formed along each side of the edge in a reasonably symmetrical manner.

Figure 16B:
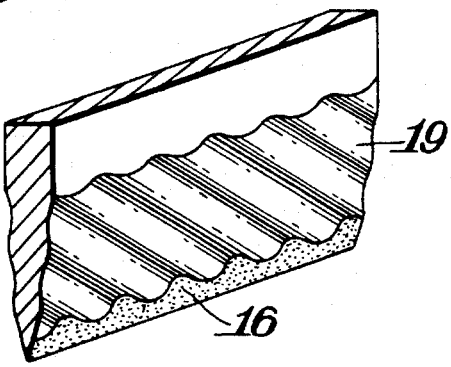
FIG. 16B is a perspective and cross-sectional view showing a finished honed blade edge in accordance with this invention.
Figure 16A:
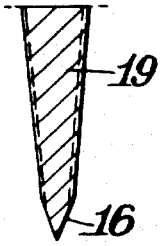
FIG. 16A is an end elevational view showing a finished honed blade in accordance with this invention.

With continued honing microfacets are first formed on the ridges of the microgrooves and subsequently microfacets will be created along the valleys of the microgrooves. At that point any edge serrations have been largely removed. FIG. 16B is a perspective view along the edge after repeated honing when well formed microfacets have been created along the sides of the edge. The line of intersection of the grooves on the first facet with the microfacet leaves a fluted structure along the facet surfaces. These flutes have sharp boundaries where they intersect the microfacets and these flutes enter into the cutting action if the food or material being cut either compresses or distorts a distance of 5 to 20 microns and comes into contact with these boundaries before severing. This novel micro structure adds to the effective sharpness and cutting ability of the "edge" and the apparent "bite" of the blade.

The method used in this invention to precisely control the geometric polishing and shaping of the burr makes it possible for the unskilled person to consistently reproduce the same high quality edge sharpness time after time. This control is achieved through the precisely formed edge geometry created in the sharpening stage or stages and, by the unique composition and physical properties of the honing disk. The flexible abrasive loaded disk, FIGS. 11 and 12, is a thicker supported truncated cone shape whose surface rotates down past the knife edge. The abrasive surface like the sharpening stage moves across and away from the edge—not into the edge. The knife blade (4) is placed between the knife guide (2) and the hold down spring (1) and moved downward as its edge makes an initial contact with the conical honing disk and until the knife edge contacts and forms a groove (37) in the knife edge guide (33). See FIGS. 8–9. Then in like fashion to the action of stage 1, the knife is firmly positioned at a fixed angle against the honing disks ±0.5 degrees and pulled successively across the left and right disks to hone the edge.

The mechanical and abrasive properties of the honing disk derives from the composition of the epoxy matrix, the solids content and particle size. A two component epoxy system is prepared with a given ratio of monomer to hardener and cured at a temperature (typically 120° C.) for a time (typically 4 hours) to give the flexibility needed. The solids content (typically 5 micron particles of aluminum oxide typically 74% by weight) and the physical characteristic such as hardness and flexibility of the epoxy matrix will determine the polishing speed and the quality of the final edge. It is important that the conical honing disk have a closely controlled flexibility, stiff enough to retain its geometry at rest but sufficiently flexible to conform to the facet face and to the mildly serrated edge structure previously created by Stage 1. This conformity insures that a gentle abrasive action takes place to remove the burr and to polish the roots of the removed burrs as shown in FIG. 16 and 17. The honing action further polishes the raised portion of the serrations along the edge.

Construction and Properties of the Honing Disks:

The honing disks (15) necessary to successfully create the ultra sharp edges as described herein must have highly unique physical properties. The disks must be only mildly abrasive in order to avoid excessive abrasion and destruction of the relatively sharp edges and the microgrooves created by the sharpening stage. The disks must, however, be sufficiently abrasive to remove the burr previously formed by the sharpening stage in a reasonably short time—for example one would like to complete the necessary honing section with only a few pulls across each of the right and left honing disks. Further the disks must be fabricated so their surfaces will not load-up with the swarf—which is the fine metal dust removed from the knife by the abrasive. It is important too that the disks not heat up excessively and that they retain adequate physical stiffness, that is not become too flexible from the heat of sharpening. It is desirable that they retain their physical properties over many years, that is the organic content should not oxidize or continue to cross-link and polymerize over its reasonable life time. If the honing disks become stiffer in time they can in use damage the edge. The grit size must be carefully selected. It has been shown that grit sizes above about 25 micron are too aggressive and injure the edge. Consequently successful honing as described in this invention requires careful selection of the organic binder, the abrasive, the abrasive size, the ratio of abrasive and organic components, the disk size, thickness and speed, and the pressure during sharpening against the knife edge. Successful honing requires that the disk have appropriate physical properties, flexibility, resiliency, stiffness, appropriate abrasiveness, that is metal removal rates, thermal properties (heat generation) an adequate but not too high ablating rate, little to no aging of its properties. Attempts to use conventional buffing means to improve the edge created by Stage 1 proved unsuccessful. Cloth wheels and fibrous wheels tend to be extremely nonuniform in their action on the edge. They must be coated frequently with a manually applied adhering abrasive which is an impractical practice for a commercial sharpener. The fabric, cloth and fibrous wheels have the major disadvantage that their nonuniform structure and nonuniform abrasive actions makes them totally unpredictable and inconsistent so that they periodically destroy the fine edge that one would like to create. Wheels made of leather and porous polyurethane materials (such as Corfram®) were impractical because they "load-up" with the sharpening debris. Hence their performance too is unpredictable and inconsistent rending them unsatisfactory for a commercial sharpener. An important advantage of the optimal compositions for the honing disks as described here is that they are homogeneous and nonfibrous, hence very uniform in composition and physical properties throughout the disk. They provide a predictable, consistent, smooth and uninterrupted action to allow precision angular honing at predictable angles with precisely and consistently the optimum angular relationship to the facet formed by the sharpening stage. The amount of pressure and effectiveness of the abrasive action for a honing disk must be the same day in and day out to provide consistently well formed microfacets and an ultrasharp edge. It is extremely easy to over abrade and destroy the edge or to have a structure that quickly glazes over and fails to sharpen at all.

The physical properties of the disks must fall within a narrow range in order to assure optimum removal of the burr formed in the sharpening stage and to form the small microfacet along the edge. A wide variety of organic materials were evaluated each with a range of abrasive particle size and content by weight. Rubber based wheels proved impractical in that they "loaded-up" rapidly and wore rapidly if loaded lightly with abrasive. When loaded with larger amounts of abrasive they abraded the edge too fast and damaged the edge. Polyurethanes noted for toughness proved too tough and did not ablate enough to expose fresh abrasive surfaces.

A wide variety of epoxy resins were evaluated with a wide range of different abrasives of different grit sizes. Only one class of epoxy proved satisfactory. The large number of commonly available and conventional epoxies proved impractical because of either excessive brittleness, excessive "loading-up" and glazing over their surfaces with the sharpening debris, tending to age and change properties with age, excessive softening as they heated during sharpening, or inadequate resiliency and flexibility.

An optimum epoxy composition was acquired from Masterbond Corporation that is composed largely of: Polyoxypropyleneamines which are aliphatic polyether primary and di- and tri-functional amines derived from propylene oxide adducts of diols and triols. This is a two part system which is mixed to create the above described chemistry. This material loaded with the proper amount of abrasive is cast into molds giving a product essentially free of strain and low in shrinkage.

This is special composition 37-3EC formulated especially for this application. It proved to have the necessary flexibility, durability, and hardness, and importantly when formulated with the appropriate quantity of abrasive it ablates fast enough to avoid "loading" and to keep fresh abrasive exposed on the surface but it does not ablate so fast that it shortens the life of the disks appreciably.

A variety of abrasives were tested. Carborundum proved less effective than aluminum oxide (alumina) in removing metal. Diamonds were effective but very expensive. The optimum grit size of aluminum oxide proved to be in the range of 5 to 12 microns. Satisfactory weight ratios of the alumina grit and epoxy were within the range of 1 to 4 parts alumina for 1 part of epoxy. Lower concentrations of abrasives were impractically slow. With higher concentrations the bonding strength of the epoxy was inadequate and cracks resulted with use. Aluminum oxide and diamonds are the preferred abrasives.

For this optimal composition of abrasive loaded epoxy the optimal disk thickness was in the range of approximately 0.08 inch to 0.125 inch at the edge of a disk two inches in diameter. This thickness gave good flexibility and conformity while maintaining the necessary abrasiveness, toughness, durability, and rubber like properties to maintain its shape over long periods of use. It softens slightly as it warms in use but not enough to interfere with its effectiveness.

The cure rate of the optimal abrasive loaded epoxy is reasonable and practical. The mixed abrasive and epoxy resin sets to its final properties in 1 to 2 hours at 212° F. but if cured for 4 hours at 220°–230° F. its properties do not change significantly during the subsequent 3 years. It was found that other epoxy mixtures that cure too slowly for example over several days will continue to change their properties over years making them impractical for this application.

The physical properties of this optimal composition of abrasive and epoxy are difficult to measure by standard procedures. It has a unique combination of "hardness", compressibility, and elasticity that can, however be characterized using a conventional Wilson Rockwell Hardness Tester. A method of characterizing this unique material is described below:

The test method uses a standard Wilson Rockwell tester equipped with a ⅞" diameter steel ball to compress under the ball a sample of this material 2×2 inches and ⅜" thick first with a standard minor weight of 10 Kilograms and then with a major weight of 60 Kilograms. The ball is lowered onto the sample first under the load of the minor weight and an initial rest height of the ball is indicated as the zero point. The major weight is then applied to the ball and the distance that the ball penetrates below the zero point (change in height) is noted as $D_1$. The major weight is removed while the minor weight remains and the remaining amount of penetration is reduced. The remaining amount of depression below its original zero point is recorded as D2. With this procedure a sample of the optimum material of this invention in less than 30 seconds compressed 229 divisions (0.0183 inches) on the Rockwell Hardness Tester when the major weight was applied. This is $D_1$. When that major load was removed the remaining depression $D_2$ was 140 divisions (0.0112 inches). The recovery, R, equals $D_1-D_2/D_1=0.39$ or 39%. With all weights removed this material returned to more than 98% of its original thickness within 30 minutes. Compositions with lighter abrasive loading recovered faster to the original thickness after this test. The recovery R as defined above and the subsequent recovery of the disks to their original shape are critically important properties for the optimum performance of these disks. Samples representative of satisfactory compositions for the abrasive loaded disks were tested as shown below:

| Sample # | % Solids in Epoxy 37-3EC | R % Recovery | $D_2$ Remaining* Depression (with 10 Kg) Divisions |
|---|---|---|---|
| 1 | 78% | 31 | 155 |
| 2 | 74% | 39 | 140 |
| 3 | 50% | 75 | |

*1 Division equals 0.00008 inches of Depression.

There is a relatively narrow range of properties that gives satisfactory performance using 5 micron grit. The optimum composition is in an even narrower range of 65–75% using the 5 micron grit. This demonstrates the criticalness of the composition and the resulting physical properties.

The typical values stated here produce satisfactory sharpness and cutting characteristics desired by the professional chef.

Satisfactory cutting edges have been produced with honing disks made by adding abrasive particles of a size within the range 1–20 microns approximately 40% to 80% by weight in the epoxy mixture. Within these ranges it is preferable to use smaller particles in the upper portion of the range of abrasive loading.

If the abrasive solids content exceeds the upper limit, the hardness of the honing disk makes it too aggressive giving an edge less sharp than desired, while a disk softer than the lower limit will increase the time required to obtain a satisfactory edge and the disk tends to load-up and glaze-over in use.

This range of solids content and particle size of the honing disk can be used to cover a variety of applications from honing heavy shop tools to fine craft knives. The typical range cited in this application has been found to produce a knife edge that is extraordinarily sharp and because of its precise edge geometry the edge will stay sharp longer in use. Other prior art methods either leave a weakened burr along the edge or create a dull edge. The specific designs of the sharpening and honing stages in combination create a unique highly sharp yet durable edge.

Other

Figure 3:
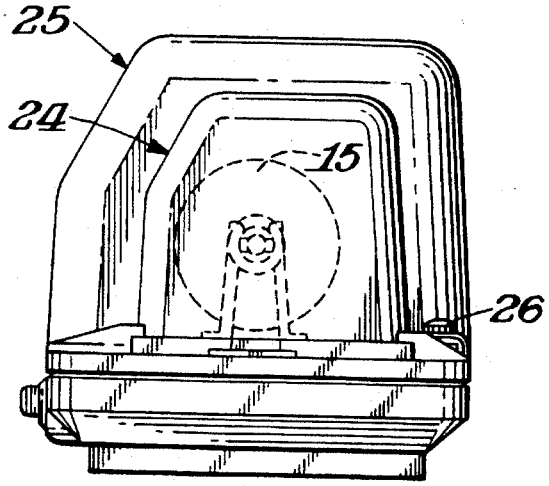
FIG. 3 is an end elevational view of the sharpening apparatus of FIGS. 1 and 2.
Figure 6:
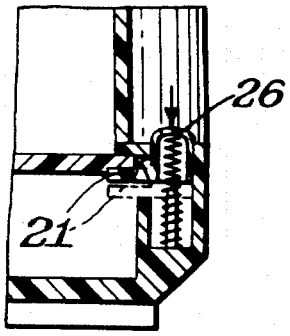
FIG. 6 is a cross-sectional view taken through FIG. 2 along the line 6—6.
Figure 5:
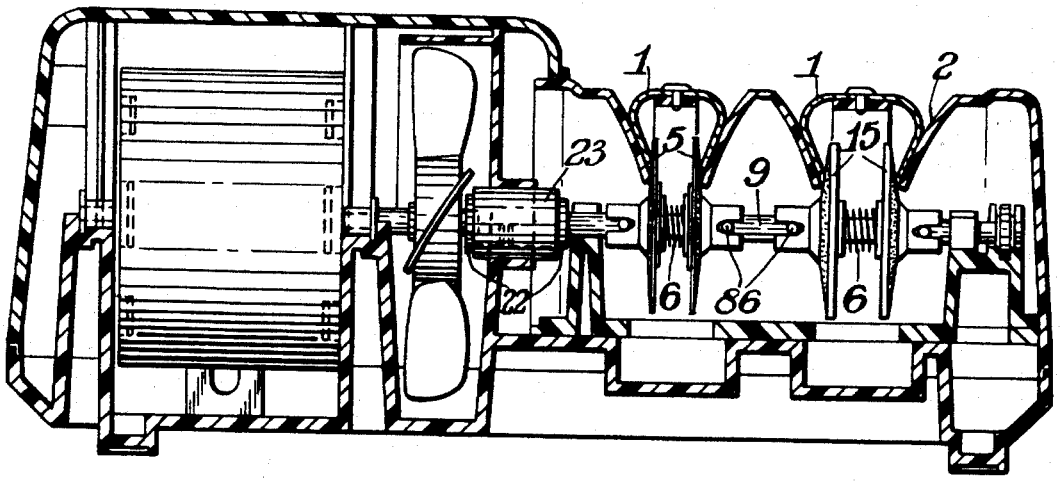
FIG. 5 is a cross-sectional view taken through FIG. 2 along the line 5—5.

A further object of this invention is to provide a unique multistage sharpener that will meet the sanitary requirements of a professional kitchen by permitting the sharpening portion (24) (including sharpening and honing stages) of the device to be easily and quickly removed for cleaning. FIG. 1 illustrates how this is accomplished. The entire sharpening section (24) may be disengaged from the motor drive section (25) by pushing the release button (26) (FIGS. 3 and 6) and sliding the sharpening section (24) away from the motor section, as shown in phantom. An automatically engaging and disengaging coupling (23) of suitable structure may be used, in part attached to the motor drive section and in part to the sharpening section, coupled for example by a splined rubber connecting sleeve. This sort of a flexible splined coupling compensates for as much as 1/16" misalignment between the sharpening. section and the motor section. As shown in FIG. 5 the flexible coupling (23) and the splines (22) affixed to both the motor/drive shaft and to the shaft of the sharpening portion (24) engage and disengage slidingly. Release button (26) is spring biased for engagement/disengagement with a pawl (21) as shown in FIG. 6. Both the sharpening and honing disks and knife blade guides are attached to a common rigid supporting structure within the entire sharpening section (24) so that their relationship is undisturbed when the sharpening section is periodically removed for cleaning and then replaced in position to the motor drive section.

Figure 22:
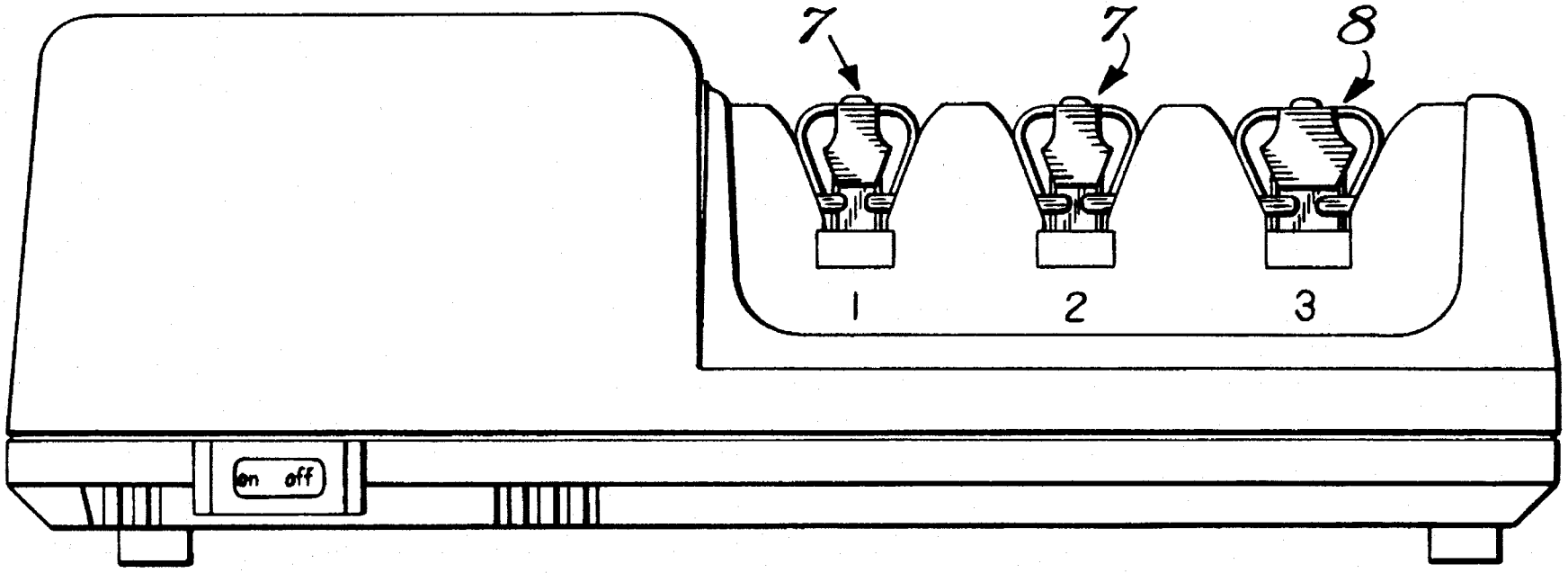
FIG. 22 is a side elevational view of a modified form of apparatus in accordance with this invention showing plural sharpening sections.

It is to be understood that although the invention has been particularly described with respect to a single sharpening section and a single honing section, the invention may also be practiced where there is more than one sharpening and/or honing sections. FIG. 22, for example, illustrates a sharpener having two sharpening sections 7 and one honing section 8. Where more than one section is used the angles should progressively increase from one section to another.

What is claimed is:

1. A sharpener for blades with an elongated cutting edge and with facets adjacent to each side of the cutting edge, comprising at least one disk having an exposed abrasive coated surface, said disk being mounted on a shaft for rotation about a horizontal axis to move said abrasive coated surface across and away from the cutting edge when the blade is moved into contact with said surface, a blade guide surface juxtaposed said disk, said blade guide surface being at a predetermined vertical angle relative to a vertical line normal to said axis of rotation of said disk, said blade guide surface being in a plane which intersects said abrasive coated surface to function as an angular guide for the blade when the blade is placed against said blade guide surface to dispose the blade in contact with said abrasive coated surface, an edge guide disposed at said disk, said edge guide providing a location of contact with the blade as the blade is moved into contact with said abrasive coated surface, said location of contact being forward of said abrasive coated surface, and said edge guide having an exposed surface for said location of contact which is made of a non-abrasive material capable of having a groove formed therein to receive the cutting edge and both of the facets of the blade with the groove in and across said edge guide to provide a guide track for the blade edge to cooperate with said angular guide as the blade is moved across said rotating abrasive coated surface to properly dispose the blade against said abrasive coated surface.

2. The sharpener of claim 1 wherein there are two side by side of said disks rotatably driven by a motor drive assembly, and said abrasive coated surface of each of said disks being of truncated cone shape.

3. The sharpener of claim 2 wherein said blade guide surface is disposed for placing the blade into contact with said abrasive coated surface at a radial distance in the range of 0.5 to 0.9 inches from said axis, and said motor drive assembly being capable of imparting a linear velocity to said abrasive coated surface at approximately 450 to 700 feet per minute.

4. The sharpener of claim 2 wherein said edge guide is disposed at both of said side by side disks whereby the same edge guide provides locations of contact for a blade contacting either of said disks.

5. The sharpener of claim 1 including a rear edge guide disposed remote from said edge guide for providing a contact surface rearward of said abrasive coated surface.

6. The sharpener of claim 1 wherein said edge guide is made of a material which is tough and lubricous.

7. The sharpener of claim 6 wherein said edge guide is made of a polypropylene material.

8. The sharpener of claim 6 wherein said edge guide is made of a polyethylene material.

9. The sharpener of claim 1 wherein said angular guide and said edge guide cooperate to dispose the cutting edge for contact with said disk on the upper front quadrant of said disk near the front edge of said disk to ensure a sharpening of the blade close to a handle for the blade.

10. The sharpener of claim 1 wherein said abrasive coated surface has a grit size in the range of about 100 to 600 grit.

11. The sharpener of claim 1 wherein there are two of said disks on said shaft separated from each other by a spring arrangement which urges said disks away from each other, and said spring arrangement applying a force in the range of 0.6 to 1.4 pounds for a displacement of 0.1 to 0.15 inches of said disks along said shaft.

12. The sharpener of claim 11 wherein said disk is a rigid disk in a sharpening section of said sharpener, said sharpener further including a honing section, at least one flexible disk mounted on a shaft for rotation about a horizontal axis in said honing section, said flexible disk having an exposed abrasive coated surface, a blade guide surface in said honing section being at a predetermined vertical angle relative to a vertical line normal to the axis of rotation of said disk, a second edge guide being disposed at said flexible disk in said honing section, and one of said edge guides being in each of said sharpening section and said honing section.

13. The sharpener of claim 12 wherein there is a set of two side by side of said rigid disks in said sharpening section, a set of two side by side of said flexible disks being in said honing section, an inverted U-shaped spring member being in at least one of said sharpening section and said honing section, said spring member having cantilevered resilient arms and an intermediate connecting portion, said connecting portion being mounted over said set of disks, and each of said arms of said spring member extending downwardly generally along a portion of a respective one of said disks.

14. The sharpener of claim 13 wherein one of said spring members is provided in each of said sharpening section and said honing section over a respective set of said disks.

15. A sharpener for blades with an elongated cutting edge and with facets adjacent to each side of the cutting edge, comprising at least one truncated cone shaped disk having an abrasive coated surface, said disk being mounted on a shaft for rotation about a horizontal axis to move said abrasive coated surface across and away from the cutting edge when the blade is moved into contact with said surface, a blade guide surface juxtaposed said disk, said blade guide surface being at a predetermined vertical angle relative to a vertical line normal to said axis of rotation of said disk, said disk having an active area for being contacted by the blade, said disk being flexible in said active area to allow said disk to flex and bend under repeated loading and to flex at the point of contact when contacted by a burr on the cutting edge, and said abrasive coated surface composed of an abrasive loaded epoxy system.

16. The sharpener of claim 15 wherein said flexible disk is in a honing section of said sharpener, said sharpener further including a sharpening section, said sharpening section having at least one rigid disk with an abrasive coated surface, said rigid disk being mounted on a shaft for rotation about a horizontal axis to move said abrasive coated surface across and away from the cutting edge when the blade is moved into contact with said abrasive coated surface to create microgrooves along the cutting edge, and said flexible disk of said honing section comprising means for modifying the microgrooves and resulting burrs along the cutting edge.

17. The sharpener of claim 15 wherein there are two side by side of said disks rotatably driven by a motor drive assembly, and said abrasive coated surface of each of said disks being of truncated cone shape.

18. The sharpener of claim 17 wherein said blade guide surface is disposed for causing a point of contact of the blade with said abrasive coated surface at a radial distance in the range of 0.5 to 0.9 inches of said axis, and said motor drive assembly being capable of imparting a linear velocity of said abrasive coated surface at about 450–700 feet per minute.

19. The sharpener of claim 15 wherein said disk has a thickness in the range of about 0.08 to 0.125 inches at the circumference of said disk.

20. The sharpener of claim 15 wherein said epoxy system is a polyoxypropyleneamine based epoxy.

21. The sharpener of claim 15 wherein said flexible disk is made of a material having a recovery in the range of 31 to 75% and a remaining depression of 140–155 divisions as measured on a Wilson Rockwell Tester using a ⅞ inch diameter steel ball with a minor weight of 10 kilograms and a major weight of 60 kilograms.

22. The sharpener of claim 15 wherein said abrasive coated surface contains abrasive particles on the order of 50 to 75% by weight in a flexible polymeric material that ablates sufficiently in use whereby abrasive particles remain exposed to the cutting edge and said abrasive coated surface is prevented from becoming glazed over with metal particles removed in the sharpening process.

23. The sharpener of claim 15 wherein said abrasive coated surface contains abrasive particles in the range of 50 to 75% by weight in an epoxy resin system composed largely of polyoxypropyleneamines which are the aliphatic polyether primary and di- and tri-functional amines derived from polypropylene oxide adducts of diols and triols.

24. The sharpener of claim 15 wherein said abrasive coated surface contains abrasive particles in the size range of 1 to 20 microns embedded in a flexible polymeric material.

25. The sharpener of claim 15 wherein an edge guide is disposed at said disk, said edge guide providing a location of contact with the blade as the blade is moved into contact with said abrasive coated surface, said location of contact being forward of said abrasive coated surface, and said edge guide having an exposed surface for said location of contact which is made of a non-abrasive material capable of having a groove formed therein to receive the cutting edge and both of the facets of the blade with the groove in and across said edge guide to provide a guide track for the blade as the blade is moved across said rotating abrasive coated surface.

26. The sharpener of claim 25 wherein said flexible disk is in a honing section of said sharpener, said sharpener including a sharpening section, a rigidly mounted disk in said sharpening section having an abrasive coated surface, and a blade guide surface in said sharpening section in a plane which intersects said abrasive coated surface of said rigidly mounted disk to function as a guide for the blade when the blade is placed against said blade guide surface to dispose the blade against said abrasive coated surface of said rigidly mounted disk.

27. The sharpener of claim 26 wherein there is a set of two side by side of said rigidly mounted disks in said sharpening section, a set of two side by side of said flexible disks being in said honing section, an inverted U-shaped spring member being in at least one of said sharpening section and said honing section, said spring member having cantilevered resilient arms and an intermediate connecting portion, said connecting portion being mounted over said set of disks, and each of said arms of said spring member extending downwardly generally along a portion of a respective one of said disks.

28. The sharpener of claim 27 wherein one of said spring members is provided in each of said sharpening section and said honing section.

29. In a sharpener for a blade with an elongated cutting edge, said sharpener including an upstanding sharpening assembly having an abrasive surface on each side of said sharpening assembly, an elongated blade guide surface juxtaposed each of said abrasive surfaces to guide the blade along and into contact with said abrasive surface, the improvement being in a spring assembly, said spring assembly including an inverted elongated U-shaped spring member, said spring member having downwardly extending cantilevered resilient arms connected to an upper intermediate connecting portion, said connecting portion being directly over said sharpening assembly, said arms extending downwardly generally along a portion of said sharpener assembly on each side of said sharpener assembly, each of said arms extending downwardly between one of said blade guide surfaces and said sharpening assembly to create a resilient angled slot between said arm and said blade guide surface directed toward its juxtaposed abrasive surface, and each of said arms being of sufficient length and shape to be sufficiently close to said blade guide surface when no blade is in said slot to assure a blade is contacted by an arm and a blade guide surface when a blade is in said slot and is moved into contact with said abrasive surface.

30. The sharpener of claim 29 wherein said arms extend substantially the entire length of said blade guide surfaces, and said arm contacting said blade guide surface when no blade is in said slot.

31. The sharpener of claim 29 including a guard member extending downwardly from said connecting portion generally perpendicular to said arms to limit access to said sharpening assembly during conditions of non-use.

32. The sharpener of claim 29 including mounting means mounting said spring member to permit said spring member to move laterally and to pivot angularly about said mounting means for accommodating the shape of the blade being sharpened.

33. A sharpener for blades comprising support structure, a motor drive assembly and a sharpening module mounted to said support structure, said sharpening module containing a plurality of abrasive coated disks, said disks being axially mounted on a shaft assembly in said module for rotation on said shaft assembly, said motor drive assembly being external of said module, said motor drive assembly having a motor driven axially rotatable shaft, a coupling unit detachably coupling said motor driven shaft to said shaft assembly for selectively rotating said disks when said motor drive assembly is activated, said coupling unit selectively coupling and uncoupling said motor driven shaft to said shaft assembly in response to a manually operable actuating member, said manually operable actuating member having a first position which physically restrains relative motion of said motor drive assembly and said module with respect to each other to prevent separation of said module from said motor drive assembly, and said manually operable actuating member having a second position which allows unobstructed separation of said module from said motor drive assembly to disengage said module from said motor drive assembly and from said support structure for permitting removal of said module from said support structure for allowing cleaning of said module independently of and separate from said motor drive assembly.

34. The sharpener of claim 33 wherein said coupling unit is a splined coupling.

35. The sharpener of claim 34 wherein said manually operable actuating member is a spring biased pawl.

36. The sharpener of claim 33 wherein said sharpening module includes a sharpening section and a honing section, said sharpening section having a set of abrasive coated disks, and said honing section having a set of abrasive coated disks.

37. The sharpener of claim 36 wherein said disks of said sharpening section are rigid disks, and said disks of said honing section being flexible disks.

38. The sharpener of claim 37 wherein each of said disks in each of said sharpening section and said honing section is provided with a blade guide surface disposed at a predetermined vertical angle relative to a vertical line normal to the axis of rotation of its said disk, said disks in at least one of said sharpening section and said honing section being provided with an edge guide having a location of contact forward of said disks, and said edge guide having a blade contact surface made of a non-abrasive material capable of having a groove formed therein to receive the cutting edge of the blade to provide a guide track for the blade as the blade is moved across said abrasive coated disks.

39. The sharpener of claim 38 wherein said disks in each of said sharpening section and said honing section are provided with said edge guide.

40. The sharpener of claim 38 including an inverted elongated U-shaped spring member in at least one of said sharpening section and said honing section, said spring member having downwardly extending cantilevered resilient arms connected to an intermediate connecting portion, said connecting portion being disposed directly over said disks, each of said arms extending downwardly generally along a portion a respective one of said disks, and each of said arms extending downwardly between said blade guide surface and its adjacent disk to create a resilient angled slot between said arm and said blade guide surface.

41. The sharpener of claim 40 wherein each of said sharpening section and said honing section is provided with said spring member.

42. The sharpener of claim 41 wherein each of said sharpening section and said honing section is provided with said edge guide.

43. The sharpener of claim 33 wherein said module includes a sharpening section and a honing section, each of said sharpening section and said honing section having a set of abrasive coated disks, said disks in said sharpening section being rigid, and said disks in said honing section being flexible.

44. The sharpener of claim 43 wherein each of said disks in each of said sharpening section and said honing section is provided with a blade guide surface disposed at a predetermined vertical angle relative to a vertical line normal to the axis of rotation of said disks, said disks in at least one of said sharpening section and said honing section being provided with an edge guide having a point of contact forward of said disks, and said edge guide having a blade contact surface made of a non-abrasive material capable of having a groove formed therein to receive the cutting edge of the blade to provide a guide track for the blade as the blade is moved across said abrasive coated disk.

45. The sharpener of claim 44 including an inverted elongated U-shaped spring member in at least one of said sharpening section and said honing section, said spring member having downwardly extending cantilevered resilient arms connected to an intermediate connecting portion, said connecting portion being disposed directly over said disks, each of said arms extending downwardly generally along a portion of said disk, and each of said arms extending downwardly between said blade guide surface and its adjacent disk to create a resilient angled slot between said arm and said blade guide surface.

46. The sharpener of claim 45 wherein each of said sharpening section and said honing section is provided with said spring member.

* * * * *

US005611726C1

(12) EX PARTE REEXAMINATION CERTIFICATE (6649th)

United States Patent

Friel et al.

(10) Number: US 5,611,726 C1

(45) Certificate Issued: Feb. 10, 2009

(54) HIGH SPEED PRECISION SHARPENING APPARATUS

(75) Inventors: Daniel D. Friel, Greenville, DE (US); Robert P. Bigliano, Wilmington, DE (US)

(73) Assignee: Edgecraft Corporation, Avondale, PA (US)

Reexamination Request:
No. 90/008,046, May 15, 2006

Reexamination Certificate for:

| | |
|---|---|
| Patent No.: | **5,611,726** |
| Issued: | **Mar. 18, 1997** |
| Appl. No.: | **08/431,497** |
| Filed: | **Apr. 28, 1995** |

(51) Int. Cl.
*B24B 9/00* (2006.01)

(52) U.S. Cl. ..... 451/177; 451/259; 451/267; 451/282; 451/293

(58) Field of Classification Search ..... 51/295; 451/177, 259, 267, 282, 293
See application file for complete search history.

(56) References Cited

U.S. PATENT DOCUMENTS

| | | | | | |
|---|---|---|---|---|---|
| 1,172,860 | A | * | 2/1916 | Aschburner | 451/549 |
| 2,841,926 | A | * | 7/1958 | Lebus | 451/65 |
| 3,332,173 | A | * | 7/1967 | McMaster et al. | 451/282 |
| 3,906,684 | A | * | 9/1975 | Marshall et al. | 51/295 |
| 4,128,972 | A | * | 12/1978 | Charvat | 51/298 |
| 4,504,283 | A | * | 3/1985 | Charvat | 51/298 |
| 4,716,689 | A | * | 1/1988 | Friel | 451/45 |
| 4,807,399 | A | * | 2/1989 | Friel | 451/45 |
| 5,245,756 | A | | 9/1993 | Howell et al. | |
| 5,245,791 | A | * | 9/1993 | Bigliano et al. | 451/282 |

FOREIGN PATENT DOCUMENTS

| | | |
|---|---|---|
| JP | S48-019292 | 6/1973 |
| JP | S59-008746 | 2/1984 |
| JP | S59-055657 | 3/1984 |
| JP | 753218 | 10/1988 |
| JP | H02-160462 | 6/1990 |

OTHER PUBLICATIONS

KAI Brochure "For You 5", Feb. 1, 1992.
KAI Brochure "For You 3", undated.
KAI Product Leaflet re "Spiral Sharpener AP–001", undated.

* cited by examiner

*Primary Examiner*—Jimmy G Foster

(57) ABSTRACT

A high speed knife sharpening apparatus where the surface of a first rotating abrasive element is that of a truncated cone and forms a first facet with microgrooves and a microburr. A second stage is a novel composite cone shaped honing wheel made up of a micro abrasive imbedded in an epoxy matrix. The honing wheel refines the edge developed in the first stage, into an erect triangular shape with a radius of curvature, at the apex (edge), of typically several microns or less depending on the hardness of the knife steel. A unique blade holding system constrains the blade to a precisely defined angle relative to each of the grinding (first) and honing (second) stages. Proportionately larger grinding forces are developed for thicker knife blades, thus sharpening times are approximately the same over the common range of knives from small paring knives (6"), large chef's knives (10") up to kitchen cleavers.

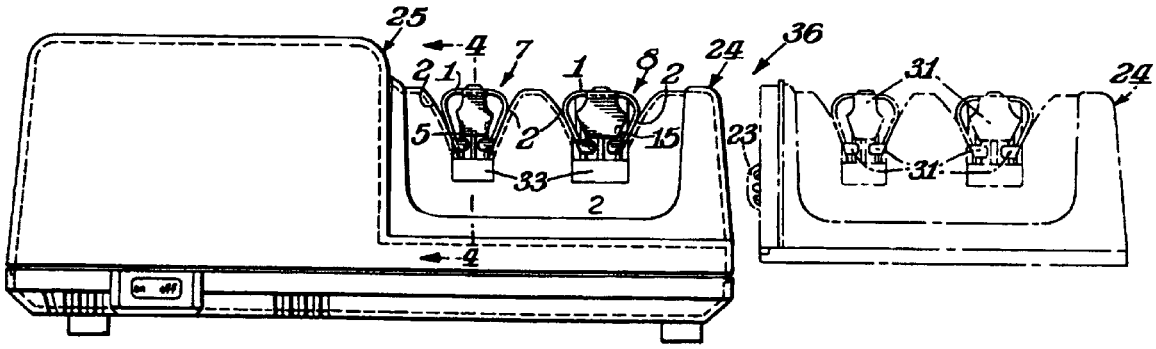

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–14 and 29–46 is confirmed.

Claims 15, 19, 20, 23 and 25 are determined to be patentable as amended.

Claims 16–18, 21, 22, 24 and 26–28, dependent on an amended claim, are determined to be patentable.

New claims 47–52 are added and determined to be patentable.

15. A sharpener for blades with an elongated cutting edge and with facets adjacent to each side of the cutting edge, comprising at least one truncated cone shaped disk having an abrasive coated surface *for honing the cutting edge and for removing any burr from the cutting edge*, said disk being mounted on a shaft for rotation about a horizontal axis to move said abrasive coated surface across and away from the cutting edge when the blade is moved into contact with said surface, a blade guide surface juxtaposed said disk, said blade guide surface being at a predetermined vertical angle relative to a vertical line normal to said axis of rotation of said disk, said disk having an active area for being contacted by the blade, said disk being flexible in said active area to allow said disk to flex and bend under repeated loading and to flex at the point of contact when contacted by a burr on the cutting edge *to remove the burr*, and said abrasive coated surface composed of an abrasive loaded epoxy system.

19. [The sharpener of claim 15] *A sharpener for blades with an elongated cutting edge and with facets adjacent to each side of the cutting edge, comprising at least one truncated cone shaped disk having an abrasive coated surface, said disk being mounted on a shaft for rotation about a horizontal axis to move said abrasive coated surface across and away from the cutting edge when the blade is moved into contact with said surface, a blade guide surface juxtaposed said disk, said blade guide surface being at a predetermined vertical angle relative to a vertical line normal to said axis of rotation of said disk, said disk having an active area for being contacted by the blade, said disk being flexible in said active area to allow said disk to flex and bend under repeated loading and to flex at the point of contact when contacted by a burr on the cutting edge, and said abrasive coated surface composed of an abrasive loaded epoxy system, and* wherein said disk has a thickness in the range of about 0.08 to 0.125 inches at the circumference of said disk.

20. [The sharpener of claim 15] *A sharpener for blades with an elongated cutting edge and with facets adjacent to each side of the cutting edge, comprising at least one truncated cone shaped disk having an abrasive coated surface, said disk being mounted on a shaft for rotation about a horizontal axis to move said abrasive coated surface across and away from the cutting edge when the blade is moved into contact with said surface, a blade guide surface juxtaposed said disk, said blade guide surface being at a predetermined vertical angle relative to a vertical line normal to said axis of rotation of said disk, said disk having an active area for being contacted by the blade, said disk being flexible in said active area to allow said disk to flex and bend under repeated loading and to flex at the point of contact when contacted by a burr on the cutting edge, and said abrasive coated surface composed of an abrasive loaded epoxy system, and* wherein said epoxy system is a polyoxypropyleneamine based epoxy.

23. [The sharpener of claim 15] *A sharpener for blades with an elongated cutting edge and with facets adjacent to each side of the cutting edge, comprising at least one truncated cone shaped disk having an abrasive coated surface, said disk being mounted on a shaft for rotation about a horizontal axis to move said abrasive coated surface across and away from the cutting edge when the blade is moved into contact with said surface, a blade guide surface juxtaposed said disk, said blade guide surface being at a predetermined vertical angle relative to a vertical line normal to said axis of rotation of said disk, said disk having an active area for being contacted by the blade, said disk being flexible in said active area to allow said disk to flex and bend under repeated loading and to flex at the point of contact when contacted by a burr on the cutting edge, and said abrasive coated surface composed of an abrasive loaded epoxy system, and* wherein said abrasive coated surface contains abrasive particles in the range of 50 to 75% by weight in an epoxy resin system composed largely of polyoxy propyleneamines which are the aliphatic polyether primary and di- and tri-functional amines derived from polypropylene oxide adducts of diols and triols.

25. [The sharpener of claim 15] *A sharpener for blades with an elongated cutting edge and with facets adjacent to each side of the cutting edge, comprising at least one truncated cone shaped disk having an abrasive coated surface, said disk being mounted on a shaft for rotation about a horizontal axis to move said abrasive coated surface across and away from the cutting edge when the blade is moved into contact with said surface, a blade guide surface juxtaposed said disk, said blade guide surface being at a predetermined vertical angle relative to a vertical line normal to said axis of rotation of said disk, said disk having an active area for being contacted by the blade, said disk being flexible in said active area to allow said disk to flex and bend under repeated loading and to flex at the point of contact when contacted by a burr on the cutting edge, and said abrasive coated surface composed of an abrasive loaded epoxy system, and* wherein an edge guide is disposed at said disk, said edge guide providing a location of contact with the blade as the blade is moved into contact with said abrasive coated surface, said location of contact being forward of said abrasive coated surface, and said edge guide having an exposed surface for said location of contact which is made of a non-abrasive material capable of having a groove formed therein to receive the cutting edge and both of the facets of the blade with the groove in and across said edge guide to provide a guide track for the blade as the blade is moved across said rotating abrasive coated surface.

*47. The sharpener of claim 33 wherein said manually operable actuating member comprises a release button.*

*48. The sharpener of claim 47 wherein said release button is an externally mounted spring biased push button.*

*49. The sharpener of claim 47 wherein said coupling unit creates a positive lock between said motor drive assembly*

*and said sharpening module which is disengaged in response to movement of said release button.*

*50. The sharpener of claim 1 wherein said disk is a rigid disk in a sharpening section of said sharpener, said sharpener further including a honing section, at least one flexible disk mounted on a shaft for rotation about a horizontal axis in said honing section, said flexible disk having an exposed abrasive coated surface, a blade guide surface in said honing section being at a predetermined vertical angle relative to a vertical line normal to the axis of rotation of said disk, a second edge guide being disposed at said flexible disk in said honing section, and one of said edge guides in each of said sharpening section and said honing section.*

*51. The sharpener of claim 1 wherein said sharpener is a multistage sharpener having a sharpening section and having a honing section for removing any burrs on the knife blade, and said edge guide being in at least one of said sharpening section and said honing section.*

*52. The sharpener of claim 25 wherein said sharpener is a multistage sharpener having a sharpening section and a honing section, and said at least one disk and said blade guide surface and said edge guide being in said honing section.*

* * * * *